United States Patent [19]

Govett

[11] Patent Number: 4,562,658

[45] Date of Patent: Jan. 7, 1986

[54] ADJUSTABLE MOUNT

[75] Inventor: Peter J. Govett, Castle Hill, Australia

[73] Assignee: Tetra Pharmaceuticals Pty. Limited, New South Wales, Australia

[21] Appl. No.: 539,061

[22] Filed: Oct. 4, 1983

[51] Int. Cl.[4] ..... F41G 1/38

[52] U.S. Cl. ..... 42/1 ST; 33/245; 33/247

[58] Field of Search ..... 42/1 ST; 33/245, 246, 33/247, 248, 249, 250

[56] References Cited

U.S. PATENT DOCUMENTS

| | | | |
|---|---|---|---|
| 2,445,595 | 7/1948 | Bengert | 42/1 ST |
| 2,743,525 | 5/1956 | Leupold | 42/1 ST |
| 2,743,526 | 5/1956 | Ivy | 42/1 ST |
| 4,216,600 | 8/1980 | Brueckner et al. | 42/1 ST |

*Primary Examiner*—Charles T. Jordan

*Attorney, Agent, or Firm*—Oblon, Fisher, Spivak, McClelland & Maier

[57] ABSTRACT

A scope mount for a rifle has a mounting stud 23 which is held in position by the engagement of its lower conical face 25 with an aperture 30 in the mounting plate 10. The stud 23 has a groove 27 in part defined by an upper conical face 28. A clamp 14 is secured to the mounting stud 23 by adjustment screws 22, 22*a* which have conical end faces that engage the conical face 28 of the stud 23 to draw the clamp down onto the mounting plate. Recoil forces are transferred to the clamp 14 through the vertical faces of the central portion 26 and head 29 of the stud 23 which engage the wall of the aperture 20 in the boss 19 of the clamp 14.

12 Claims, 8 Drawing Figures

ADJUSTABLE MOUNT

FIELD OF THE INVENTION

This invention relates to the attachment of sights and other ancillary components to rifles and the like.

For the sake of convenience, the invention will be described in relation to the mounting of a sight to a rifle but it is to be understood that the invention is not limited thereto.

Hitherto, various mounts have been proposed for use with rifles and these have usually included a split ring clamp which is secured to a mounting plate screwed to the action of the rifle. However, the prior art proposals have suffered from various disadvantages not the least of which is the frequent loss of fine adjustment. In addition, they have been cumbersome to assemble and do not lend themselves to rapid removal of the sight. Furthermore, the general design of the prior art mounts has been such that the recoil or internal forces of the firearm have been transferred to the sight through the adjustment screws which are not specifically designed for that purpose.

DISCLOSURE OF INVENTION

It is an object of this invention to provide an improved mount for rifles and the like which permits convenient, frequent and rapid placement and removal of the sight or other accessory without adversely affecting the fine adjustment of the mount.

According to the invention there is provided a mount for a rifle or the like comprising a mounting stud adapted to be secured to the rifle and having a grooved portion in part defined by a conical head, a body portion having an aperture which freely receives the stud; and adjustment screws threaded through the body and engaged with opposite sides of the stud so that loosening of one adjustment screw and tightening of the other adjustment screw will move the body relative to the stud, said screws having conical end faces which engage with the conical head of the stud so that when tightened the body is driven down onto the rifle.

Preferably, the mount further includes a mounting plate for securing the stud to the rifle, in which case the mounting plate has an aperture for receiving the stud which is correspondingly shaped thereto so that when the adjustment screws are tightened the stud is firmly engaged in the mounting plate and the body portion is drawn down onto the mounting plate.

In a preferred form of the invention, the body portion of the mount is constituted by a first portion of a split ring clamp and the mount further includes a second portion of the split ring clamp and means for securing the clamp portions together.

BRIEF DESCRIPTION OF THE DRAWINGS

In order that the invention may be more readily understood and put into practical effect, reference will now be made to the accompanying drawings in which.

DETAILED DESCRIPTION OF THE PREFERRED EMBODIMENTS

Figure 1:
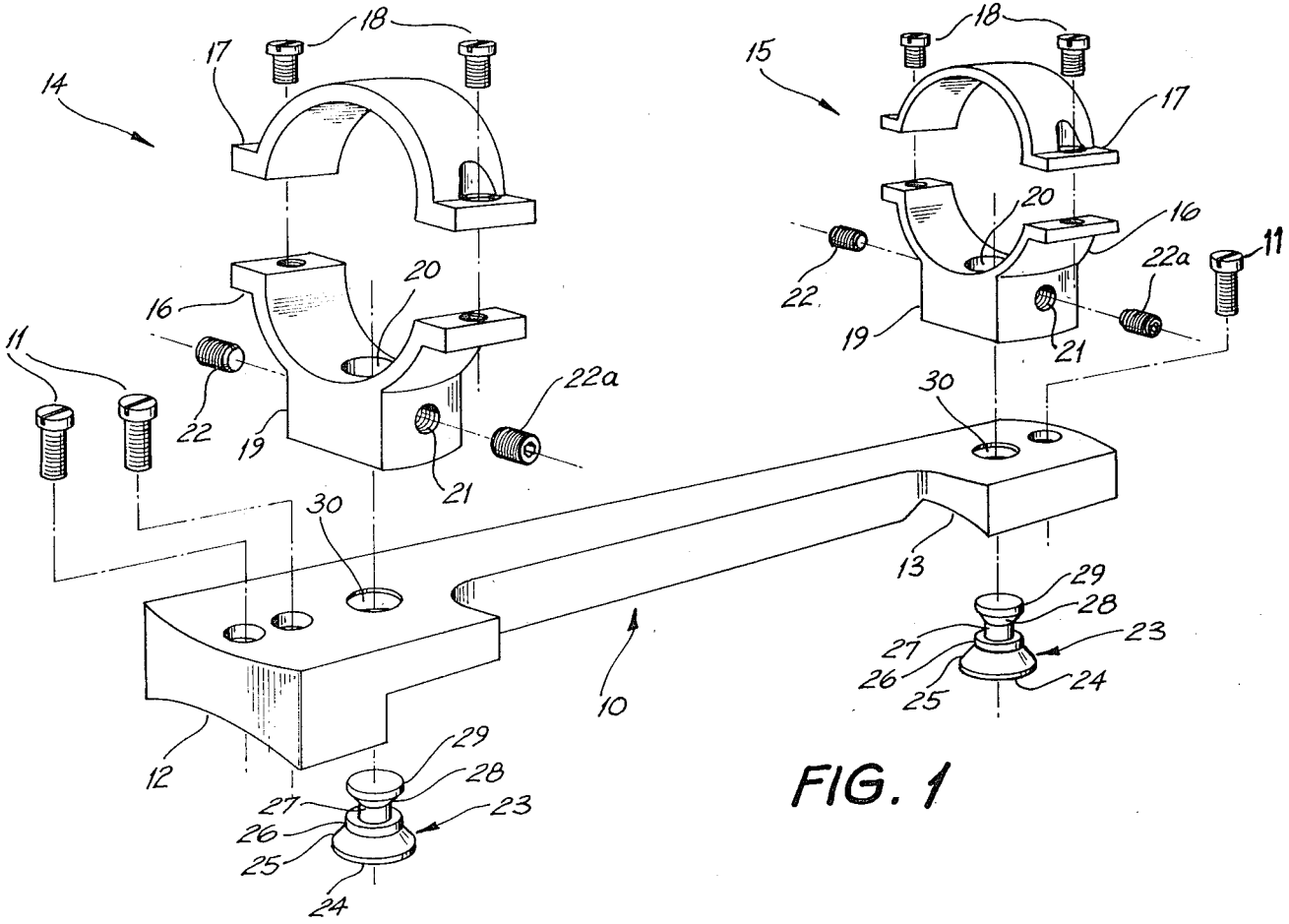
FIG. 1 is an exploded view of a double clamp mount for a rifle or the like according to one embodiment of the invention.
Figure 2:
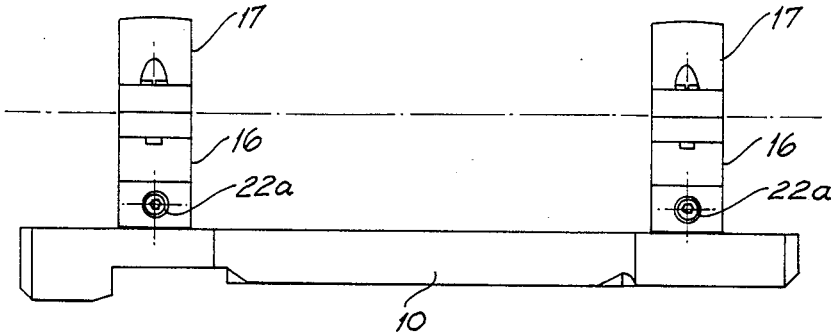
FIG. 2 is a side elevational view of the mount shown in FIG. 1 when assembled.
Figure 3:
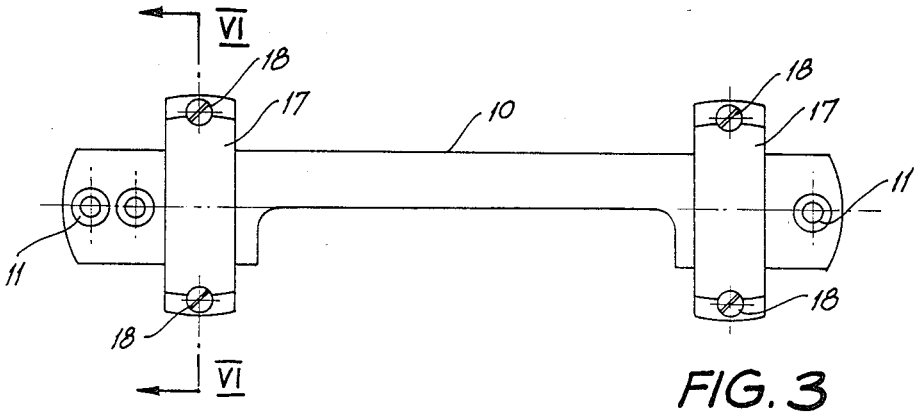
FIG. 3 is a plan view of the mount shown in FIG. 2.
Figure 4:
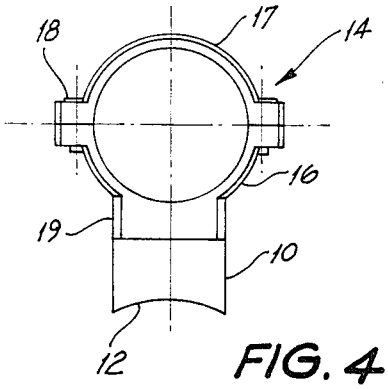
FIG. 4 is a front view of the mount shown in FIG. 2.
Figure 5:
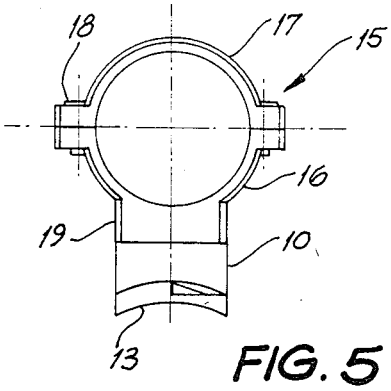
FIG. 5 is a rear view of the mount shown in FIG. 2.

In the embodiment shown in FIGS. 1 to 6, the double clamp mount includes a mounting plate 10 which is secured to the action of a rifle by means of screws 11. The bottom surfaces 12, 13 of the mounting plate 10 are contoured (as can be clearly seen in FIGS. 4 and 5) to ensure a secure fit on the rifle.

Each clamp 14, 15 is of the split ring type and has a lower clamping portion 16 and an upper clamping portion 17 which are joined together by clamping screws 18. Each lower clamp portion 16 has a mounting boss 19 which when the mount is assembled sits squarely on the mounting plate 10. Each mounting boss 19 has a central elongated aperture 20 and side apertures 21 which are in communication therewith and which are threaded to receive opposed adjustment screws 22, **22*a***.

The lower clamp portions 16 are secured to the mounting plate by means of studs 23. As can be best seen in FIG. 7, each stud 23 has a cylindrical base 24, a conical mounting face 25, a cylindrical central portion 26, a cylindrical stem 27, a conical adjustment face 28 and a cylindrical head 29. The mounting plate 10 has an aperture 30 which, as shown in FIG. 6, is correspondingly shaped to receive the conical mounting face 25 of the mounting stud 23.

Figure 6:
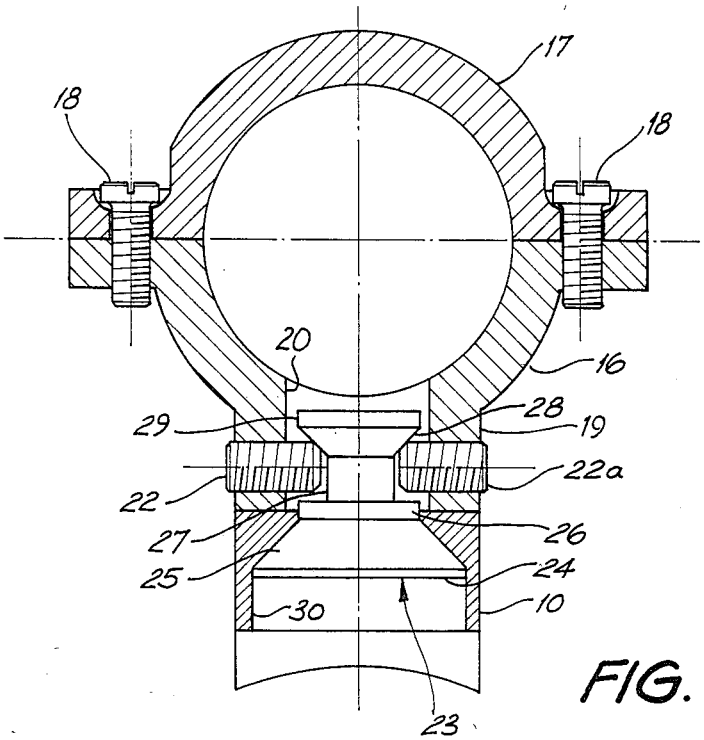
FIG. 6 is an enlarged view taken along lines VI—VI of FIG. 3.
Figure 7:
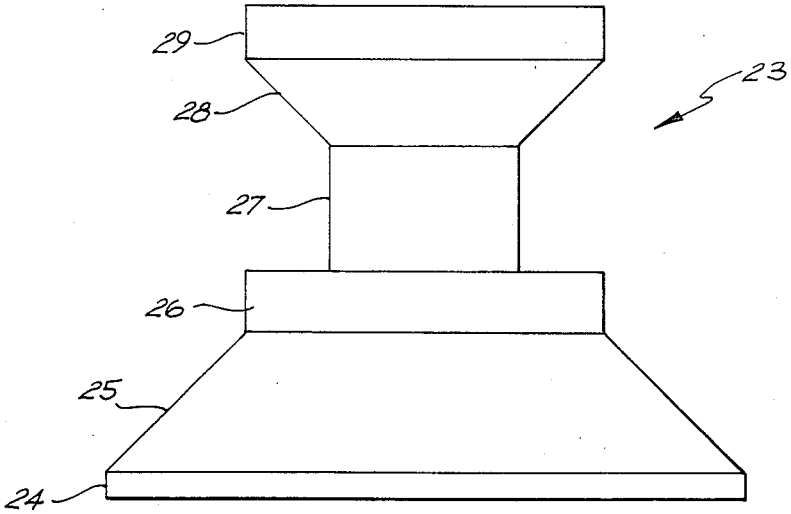
FIG. 7 is an enlarged view of the mounting stud which forms part of the mount shown in FIGS. 2 to 6, and, FIG. 8 is a perspective view of a single clamp mount for a rifle or the like according to a second embodiment of the invention.

When the studs 23 are in their correct positions the cylindrical central portion 26, the cylindrical stem 27, the conical adjustment face 28 and the cylindrical head 29 of each stud 23 project above the mounting plate 10 (as can be seen in FIG. 6) and are positioned within the aperture 20 in the mounting boss 19 of the lower clamp portion 16. When the screws 22, **22*a* are tightened, their tapered end faces engage the conical adjustment face 28 of the stud 23, and a downwards force is imparted on the mounting boss 19 once the conical mounting face 25 has seated home in the correspondingly shaped aperture 30 of the mounting plate 10. In this way, the lower clamp portion 16 and the mounting 10** are clamped together with considerable force.

The studs 23 are, in this instance, made from alloy steel and subsequently hardened by heat treatment to ensure that they do not readily deform under the action of the screws 22, **22*a*. The recoil forces are transferred to the lower clamp portion 16 through the vertical faces of the central portion 26 and the head 29 both of which engage the wall of aperture 20 in the mounting boss 19. The relatively large area of engagement between the studs 23 and the mounting plate 10 aids the transference of recoil forces, and both clamps 14, 15** share the recoil.

Windage adjustment is achieved by loosening one of the screws 22, **22*a* and tightening the other so that the lower clamp portion 16 is moved sideways across the stud 23. The dimension of the major axis of the aperture 20** is so chosen as to allow maximum adjustment.

Figure 8:
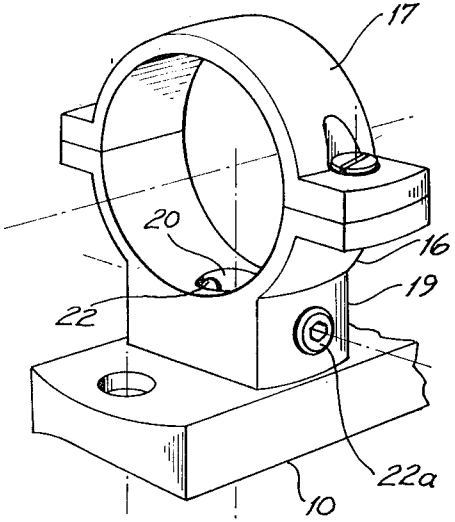

In the embodiment shown in FIG. 8, the mount has only one clamp 14 but in all other respects is resembles the mount shown in FIGS. 1 to 7.

In a further embodiment of the invention, the mounting plate 10 is discarded and the stud is rigidly secured to the rifle by screws, welding, riveting or in any other convenient way. In yet another embodiment of the invention, the body portion of the attachment to be fitted to the rifle has the apertures 20 and 21 so that the use of the clamping ring may be avoided.

Various other modifications may be made in details of design and construction without departing from the scope and ambit of the invention.

I claim:

1. A mount for the attachment of at least one sight to a rifle, said mount comprising:

(a) a mounting stud adapted to be secured to the rifle, said mounting stud having a groove portion in part defined by a conical face and having a cylindrical surface on each side of said groove portion;

(b) a body portion having a first aperture sized and shaped so that the opposing walls of said first aperture engage said cylindrical surfaces on said mounting stud in the direction parallel to the axis of the rifle, but so that said body portion can move freely relative to said mounting stud in the direction transverse to the axis of the rifle; and (c) a pair of opposed adjustment screws threaded through said body portion in the direction transverse to the axis of the rifle and extending into said first aperture, said pair of opposed adjustment screws engaging with opposite sides of said conical face of said mounting stud so that loosening of one of said pair of opposed adjustment screws and tightening of the other one of said pair of opposed adjustment screws will move said body portion in relation to said mounting stud in the direction transverse to the axis of the rifle, each one of said pair of opposed adjustment screws having a conical end face which engages with said conical face of said mounting stud so that, when said pair of adjustment screws are tightened, said body portion is drawn down onto the rifle.

2. A mount according to claim 1 wherein the mounting stud is rigidly secured to the rifle.

3. A mount for a rifle according to claim 1 wherein said mounting stud has a conical mounting face adjacents its base and the mount further includes a mounting plate for securing said mounting stud to the rifle, said mounting plate having a second aperture for receiving said mounting stud which is correspondingly shaped thereto so that, when said pair of opposed adjustment screws are tightened, said mounting stud is firmly engaged in said mounting plate and said body portion is drawn down onto said mounting plate.

4. A mount according to claim 1 wherein said body portion is a first portion of a split ring clamp and the mount further includes a second portion of said split ring clamp and means for securing said first and second portions of said split ring clamp together.

5. A mount according to claim 3 wherein said body portion is a first portion of a split ring clamp and the mount further includes a second portion of the said split ring clamp and means for securing said first and second portions of said split ring clamp together.

6. A mount according to claim 5 wherein there are two split ring clamps spaced along said mounting plate each retained on said mounting plate by its own mounting stud.

7. A mount for the attachment of at least one sight to a rifle, said mount comprising:

(a) a mounting stud adapted to be secured to the rifle, said mounting stud having:

(i) a cylindrical base;

(ii) a conical mounting face concentric to and projecting integrally from said cylindrical base;

(iii) a cylindrical central portion concentric to and projecting integrally from said conical mounting face;

(iv) a cylindrical stem concentric to and projecting integrally from said cylindrical central portion;

(v) a conical adjustment face concentric to and projecting integrally from said cylindrical stem; and (vi) a cylindrical head concentric to and and projecting integrally from said conical adjustment face;

(b) a body portion having a first aperture sized and shaped so that opposing walls of said first aperture engage said cylindrical central portion and said cylindrical head on said mounting stud in the direction parallel to the axis of the rifle, but so that said body portion can move freely relative to said mounting stud in the direction transverse to the axis of the rifle; and (c) a pair of opposed adjustment screws having tapered end faces, said pair of opposed adjustment screws being threaded through said body portion in the direction transverse to the axis of the rifle and perpendicular to the axis of said mounting stud, said pair of opposed adjustment screws extending into said first aperture and said tapered end faces of said pair of opposed adjustment screws engaging with opposite sides of said conical adjustment face of said mounting stud, whereby:

(d) when both of said pair of opposed adjustment screws are tightened against said conical adjustment face of said mounting stud, said body portion is drawn down onto the rifle and, (e) when one of said pair of opposed adjustment screws is loosened and the other one of said pair of opposed adjustment screws is correspondingly tightened, said body portion is moved relative to said mounting stud in the direction transverse to the axis of the rifle.

8. A mount as recited in claim 7 wherein said mounting stud is rigidly secured to the rifle.

9. A mount as recited in claim 7 and further comprising a mounting plate for securing said mounting stud to the rifle, said mounting plate having a second aperture sized, shaped, and positioned to receive and closely engage said cylindrical base, said conical mounting face, and a portion of said cylindrical central portion of said mounting stud, whereby, when both of said pair of opposed adjustment screws are tightened against said conical adjustment face of said mounting stud, said mounting stud is drawn firmly against corresponding surfaces of said second aperture and said body portion is drawn down onto said mounting plate.

10. A mount as recited in claim 9 wherein said body portion is a first portion of a split ring clamp and the mount further includes a second portion of said split ring clamp and means for securing said first and second portions of said split ring clamp together.

11. A mount as recited in claim 10 wherein there are two split ring clamps spaced along said mounting plate each retained on said mounting plate by its own mounting stud.

12. A mount as recited in claim 7 wherein said body portion is a first portion of a split ring clamp and the mount further includes a second portion of said split ring clamp and means for securing said first and second portions of said split ring clamp together.

* * * * *